United States Patent [19]

Sawada et al.

[11] 4,294,437

[45] Oct. 13, 1981

[54] SLIDE CLOSURE FOR THE POURING NOZZLE OF A MOLTEN METAL VESSEL

[75] Inventors: Hajimu Sawada, Kawasaki; Hisao Inubushi, Yokohama, both of Japan

[73] Assignees: Nippon Kokan Kabushiki Kaisha, Tokyo; Nippon Rotary Nozzle Co., Ltd., Kawasaki; Kokan Kikai Kogyo Kabushiki Kaisha; Tokyo Yogyo Kabushiki Kaisha, both of Tokyo, all of Japan

[21] Appl. No.: 83,970

[22] Filed: Oct. 11, 1979

[30] Foreign Application Priority Data

Oct. 12, 1978 [JP] Japan ..... 53-124654

[51] Int. Cl.[3] ..... C21C 5/48

[52] U.S. Cl. ..... 266/272

[58] Field of Search ..... 75/60, 53; 266/272

[56] References Cited

U.S. PATENT DOCUMENTS

| | | | |
|---|---|---|---|
| 3,436,023 | 4/1969 | Thalmann | 266/272 |
| 3,581,948 | 6/1971 | Detalle | 266/272 |
| 4,093,452 | 6/1978 | Spenceley | 75/53 |

FOREIGN PATENT DOCUMENTS

| | | | |
|---|---|---|---|
| 1449344 | 9/1976 | United Kingdom | 266/272 |

*Primary Examiner*—P. D. Rosenberg

*Attorney, Agent, or Firm*—Fleit & Jacobson

[57] ABSTRACT

A slide closure for the pouring nozzle of a molten metal vessel of the type comprising a fixed plate attached to the bottom portion of the vessel and a sliding plate pressed against the lower surface of the fixed plate brick, whereby the sliding plate is rotated to open and close the vessel pouring nozzle, and further comprising a supporting member or rotor adapted to be rotated with the sliding plate brick as a unit by a driving source and supporting means for slidably supporting the rotor and pressing the sliding plate brick against the fixed plate brick with a vessel bed plate serving as a supporting point, characterized in that said supporting means comprises a first supporter for surrounding and slidably supporting the rotor and a second supporter fastened to the vessel bed plate by means of pins with a dish spring interposed between the second supporter and the lower side of the annular projection of the first supporter to enclose the latter whereby the second supporter urges the first supporter upwardly.

2 Claims, 5 Drawing Figures

SLIDE CLOSURE FOR THE POURING NOZZLE OF A MOLTEN METAL VESSEL

BACKGROUND OF THE INVENTION

This invention relates to slide closures for the pouring nozzles of molten metal vessels, and more particularly the invention relates to a rotary slide closure which is designed so that adjustment of the contact pressure between the fixed plate brick and the sliding plate brick and inspection of the slide contacting surfaces of the fixed and sliding plate bricks can be accomplished easily.

Sliding closures have recently been used widely for the purpose of opening and closing the pouring nozzles of vessels for molten metal, such as ladles for molten steel. In other words, it has been the general practice to use a closure comprising a fixed plate brick having a pouring opening and arranged in close contact with the bottom portion of a vessel and a sliding plate brick having at least one opening and pressed against the lower surface of the fixed plate brick to make a rotary or reciprocating motion, whereby the movement of the sliding plate brick brings the opening in the sliding plate brick into and out of alignment with the pouring opening to open and close the vessel pouring nozzle.

An exemplary form of the known rotary type slide closures is shown in FIG. 1.

In the figure, numeral 1 designates the outer shell of a molten metal vessel whose inner surface is lined with a refractory brick 2. An open place is made in the bottom portion of the vessel where a pouring nozzle is to be formed and an upper nozzle brick 3 with an opening 3A is firmly fitted in the bottom opening. A fixed plate support 7 is placed in close contact with the lower surface of the shell 1 so as to enclose the bottom opening. A fixed plate brick 4 is received in the fixed plate support 7 so as to be placed in close contact with the upper nozzle brick 3 with its opening 4A being aligned with the opening 3A. The openings 3A and 4A form the pouring nozzle. Rotatably pressed against the lower surface of the fixed plate brick 4 is a sliding plate brick 5 which is received in a sliding plate support 8 (hereinafter referred to as a rotor). The sliding plate brick 5 is formed with two openings 5A, 5A. A gear 8A is formed on the periphery of the rotor 8 and the gear 8A is rotatable from a driving source which is not shown so as to rotate the sliding plate brick 5 in sliding contact with the fixed plate brick 4. Pouring nozzles 6, 6 are placed in close contact with the lower surface of the sliding plate brick 5 in such a manner that their openings 6A are aligned with the openings 5A and the pouring nozzles 6 are held, along with the sliding plate brick 5, in place by the rotor 8.

The rotor 8 is slidably supported in a frame 10 at a mating surface 9 and the frame 10 is provided with a plurality of spring cases 11 on its peripheral portion.

On the other hand, a bed plate 16 is firmly fastened to the lower surface of the shell 1 so as to surround the pouring opening 3A. A base plate 15 is secured to the bed plate 16 with four bolts 17. As shown in the Figure, the base plate 15 holds the fixed plate support 7 in place and the plate 15 is formed with holes for through-bolts 14 at positions which are in alignment with the tops of the spring cases 11. The bolts 14 which are inserted in the holes and held in place by their heads, are each loosely fitted in one of the spring cases 11. A coil spring 13 is mounted in each spring case 11 to surround the bolt 14. The lower end of the spring 13 is supported by a washer 12 threadedly fitted on the bolt 14. As a result, by fastening the base plate 15 to the bed plate 16, the fixed plate support 7 is held in close contact with the shell 1. By turning the other ends 14A of the bolts 14 with a jig so as to vertically move the washers 12 and thereby to adjust the force of the springs 13, it is possible to obtain the suitable pressure for pressing the fixed and sliding plate bricks 4 and 5 against each other.

The operation of this pouring nozzle closure is as follows. When the rotor 8 is rotated from the driving source, the openings 5A of the sliding plate brick 5 are brought into or out of alignment with the pouring nozzle 3A, 4A to open or close the pouring nozzle. Since the fixed and sliding plate bricks 4 and 5 are pressed against each other with the required contact pressure, there is no danger of the molten steel leaking from their contact surface. However, the slide closure is used with high temperature molten steel of about 1600° C. and consequently its opening and closing operations will eventually become incomplete due to the wear of the fixed and sliding plate bricks. While it is dependent on the properties and use condition of the refractory material for the closure, generally it is necessary to replace the closure with a new one each time the ladle is used 4 to 5 times.

In order to replace the slide closure, the closure is first disconnected with the driving source and then the bolts 17 are removed, thus detaching from the bed plate 16 the base plate 15 which is assembled with the fixed plate brick 4, the fixed plate support 7, the sliding plate brick 5, the rotor 8 and the frame 10. The thus detached assembly is generally called as a cassette.

After the cassette has been removed, the bolts 14 are turned and removed and then the base plate 15 is detached from the cassette. Since this allows the fixed and sliding plate bricks 4 and 5 to be separated from each other, the fixed and sliding plate bricks 4 and 5 are replaced and the pouring nozzles 6 are also replaced in case of necessity. After the bricks requiring replacement have been changed in this way, the cassette is reassembled, the springs 13 are readjusted, the contact pressure between the fixed and sliding plate bricks 4 and 5 are adjusted to the desired value and then the cassette is fixed to the bed plate 16 with the bolts 17. To speed up the replacement operation, it has also been practiced to prepare a separate cassette equipped with new fixed and sliding plate bricks and mount it in place upon removal of the old cassette.

However, the above method of using the closures in cassette form and replacing the old cassette with a new one to speed up the replacement of the fixed and sliding plate bricks, has the disadvantage of requiring much skill and time in assemblying the cassettes. In other words, the operation of compressing the springs 13 to generate the desired uniform pressing force, coupled with the large number of the springs 13, requires much time and skill. Moreover, it is necessary to remove the cassette from the molten metal vessel and replace the worn fixed and sliding plate bricks at another place, and also inspection of the slide contacting surfaces of the fixed and sliding plate bricks requires about the same amount of labor and time as in the case of replacement.

While the rotary type slide closure shown in FIG. 1 has been described as an example of the prior art slide closures, the slide closure of the reciprocating type differs from the rotary type only in that the closure makes a reciprocating motion in place of the rotary motion and consequently the reciprocating type involves the similar disadvantages.

SUMMARY OF THE INVENTION

It is an object of the invention to provide a slide closure for the pouring nozzles of molten metal vessels which is capable of easily adjusting and making uniform the contact pressure between a fixed plate brick and a sliding plate brick.

It is another object of the invention to provide a slide closure for the pouring nozzles of molten metal vessels which can be assembled and disassembled easily and which is capable of visually inspecting easily the slide contacting surfaces of a fixed plate brick and a sliding plate brick.

In accordance with the invention there is thus provided a slide closure for the pouring nozzle of a molten metal vessel comprising a fixed plate brick with at least one pouring opening and attached to the bottom of a molten metal vessel, a sliding plate brick having one or more openings and pressed against the lower surface of the fixed plate brick so as to be rotated to selectively bring the openings into and out of alignment with the pouring opening and thereby to open and close the pouring opening, a support or rotor receiving the sliding plate brick and rotatable with the latter as a unit from a driving source, and supporting means slidably supporting the support or rotor and also pressing, with a vessel bed plate serving as a supporting point, the rotor in a direction to press the sliding plate brick against the fixed plate brick, and the slide closure is characterized in the following.

The supporting means comprises a first supporter for surrounding and slidably supporting the rotor and including an outwardly projected annular portion, and a second supporter fastened to the bed plate of the vessel by means of pins with a countersunk spring being held between the second supporter and the lower side of the annular projection of the first supporter so as to urge the first supporter upwardly or to press the sliding plate brick against the fixed plate brick.

In accordance with a preferred embodiment of the slide closure for the pouring nozzle of a molten metal vessel according to the invention, the slide closure further comprises a plurality of clamp means each having upper and lower claws for detachably gripping the upper edge of the rotor and the lower edge of the second supporter and the upper edge of the rotor is formed with a plurality of gentle projections, whereby the clamp means are inserted to grip the portions of the rotor upper edge having no projections and the lower edge of the second supporter so that when the rotor is slid, the claws of the clamp means ride on the projections to grip tightly the rotor and the second supporter.

BRIEF DESCRIPTION OF THE DRAWINGS

FIG. 3 shows side and sectional views looked in the direction of an arrow line III—III of FIG. 4.

FIG. 4 is a sectional view looked upwardly in the direction of an arrow line IV—IV of FIG. 2.

DESCRIPTION OF THE PREFERRED EMBODIMENT

Figure 1:
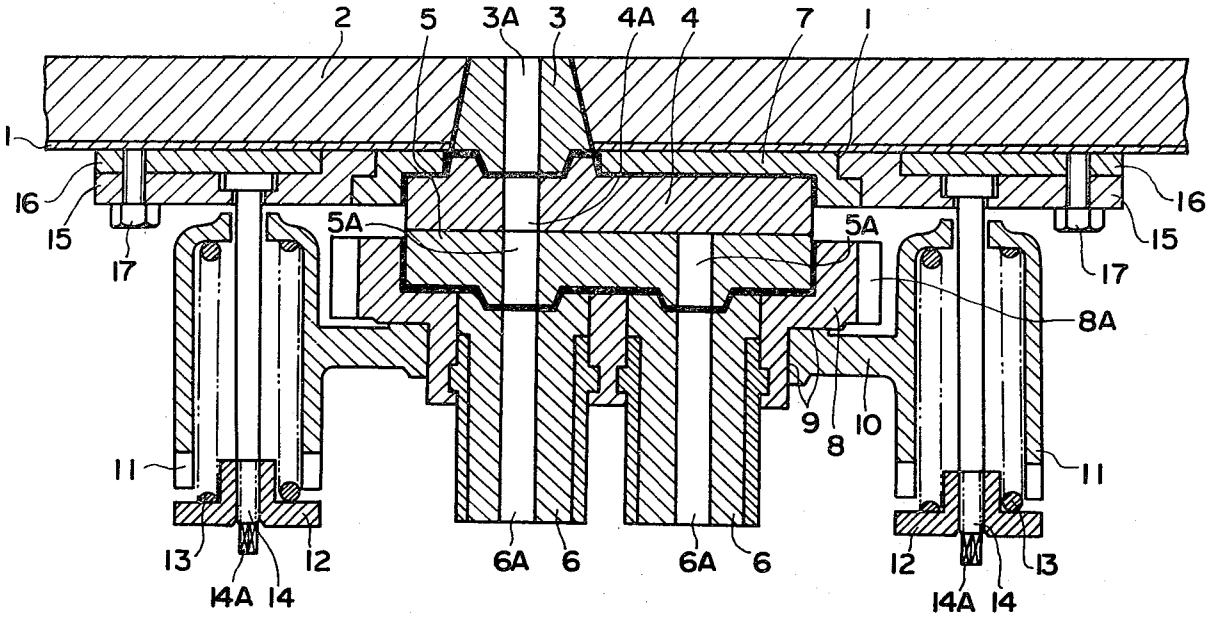
FIG. 1 PRIOR ART
FIG. 1 is a longitudinal sectional view of an exemplary prior art rotary type slide closure.
Figure 2:
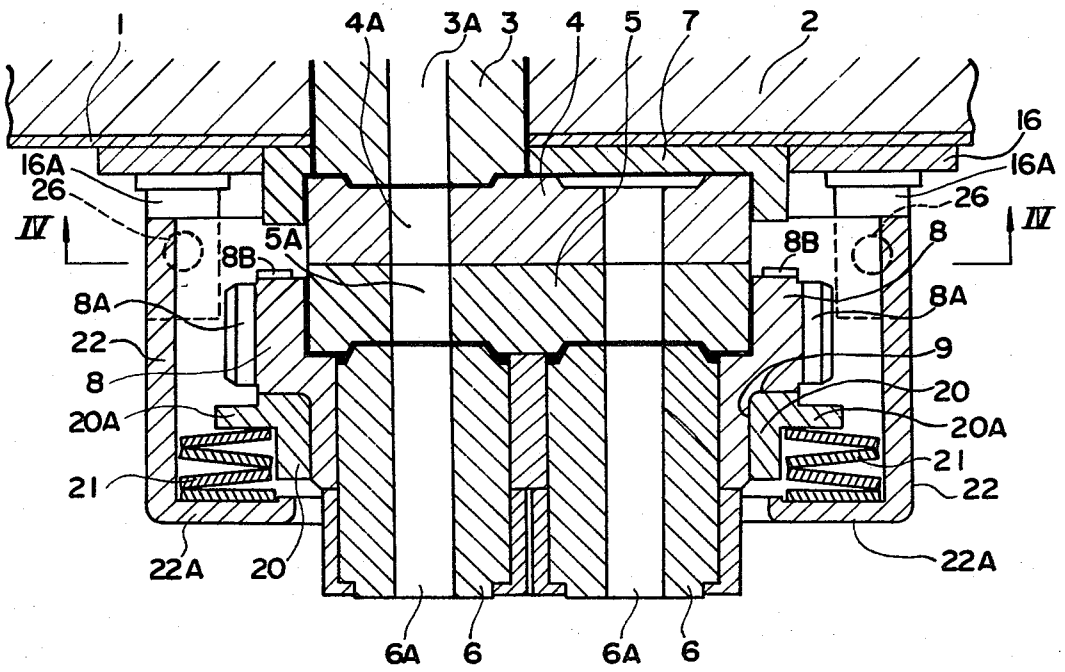
FIGS. 2 to 4 show an embodiment of a rotary slide closure according to the invention, with FIG. 2 showing side and sectional views looked in the direction of an arrow line II—II of FIG. 4.
Figure 3:
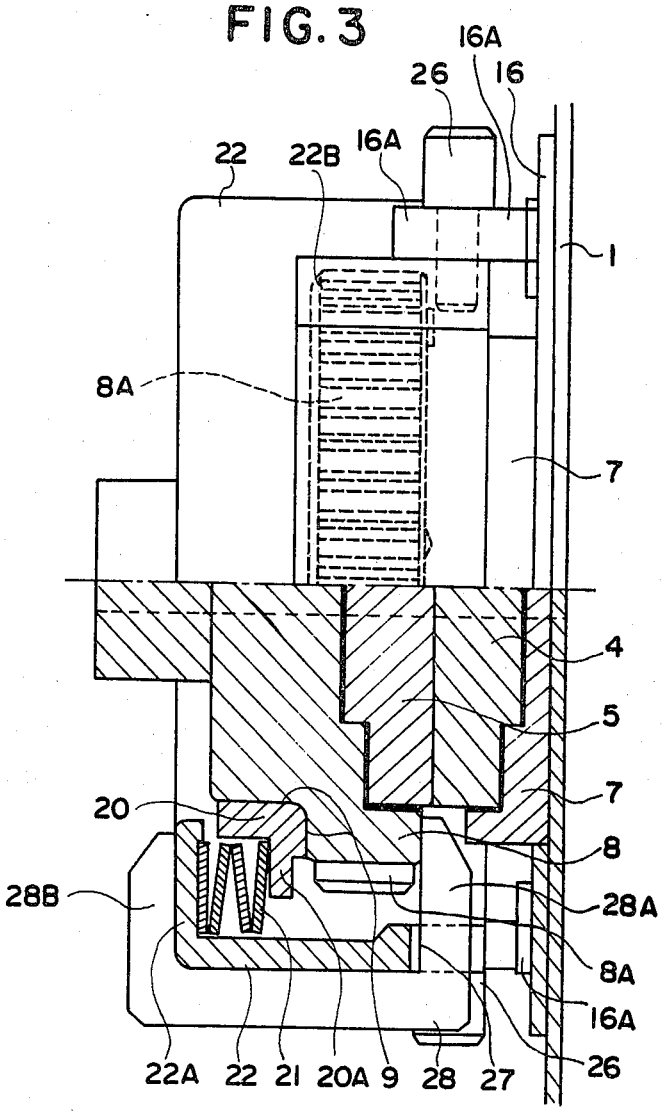
Figure 4:
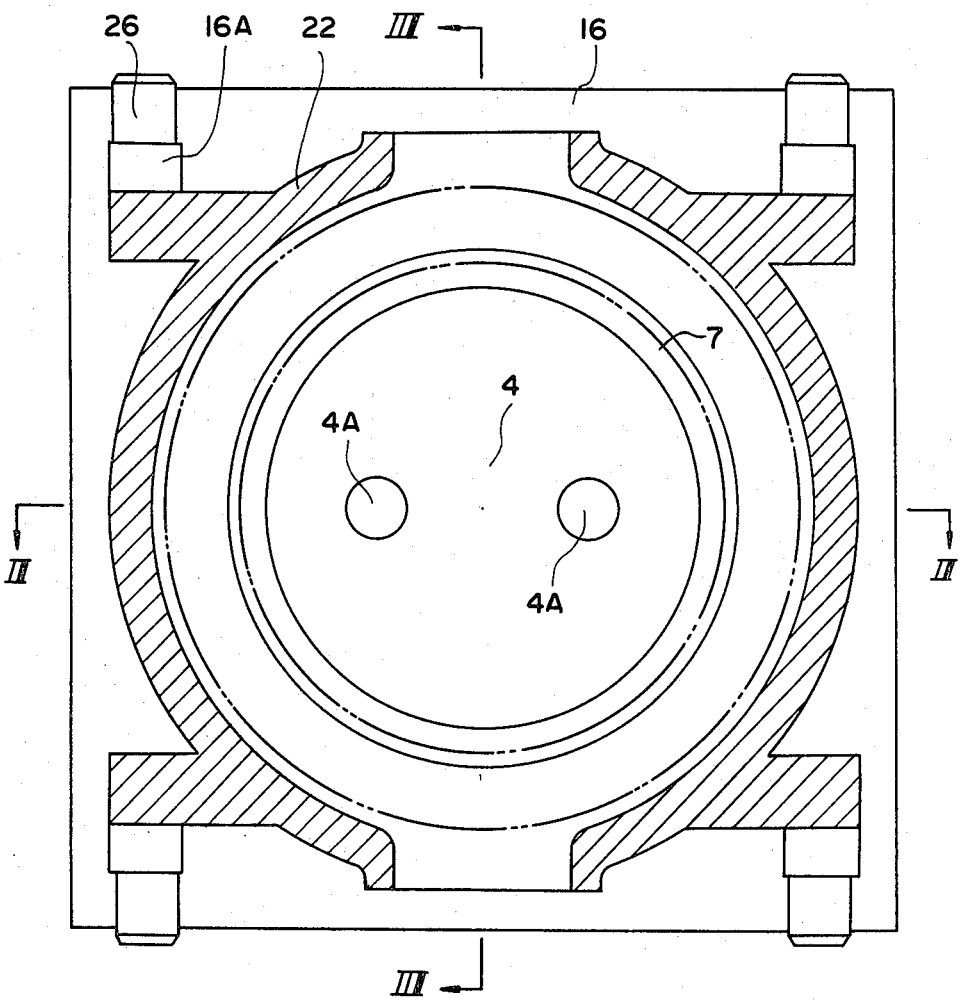

The slide closure according to the invention will now be described in greater detail with reference to the embodiment shown in FIGS. 2 to 4. This embodiment is identical with the prior art closure of FIG. 1 in that a fixed plate support 7 is firmly secured, along with a bed plate 16, to a shell 1, that a fixed plate brick 4 is received and secured to the fixed plate support 7 with means (e.g., bolts) which are not shown, that a sliding plate brick 5 is rotated along with a supporting member or rotor 8 while being pressed against the fixed plate brick 4, that nozzle bricks are provided and so on. Thus, in FIGS. 2 to 4, like component parts have been given the same reference numerals as in FIG. 1 and will not be described.

In accordance with the slide closure of this invention, the sliding plate support or rotor 8 is slidably supported at a surface 9 by means of a first supporter 20 arranged to surround the rotor 8. The bed plate 16 secured to the shell 1 is provided with four hangers 16A positioned to surround the fixed plate brick 4 and the sliding plate brick 5 and each having a pin hole. On the other hand, a second supporter 22 is arranged in such a manner that the pin holes in its pin supports 22B at the four upper end corners are aligned with the pin holes in the hangers 16A of the bed plate 16 and horizontal pins 26 are fitted in the pin holes. In this way, the second supporter 22 is suspended so as to surround the rotor 8.

The first supporter 20 is formed with an outwardly projected annular portion 20A and a dish spring 21 is mounted between the annular projection 20A and a bottom plate 22A of the second supporter 22 so as to surround the first supporter 20. The dish spring 21 comprises a plurality of spring elements which are usually arranged one upon another like an accordion (in the illustrated case there are three spring elements in addition to the lowermost spring bearing) so as to surround the first supporter 20. The first supporter 20 is forced upward by the resilience of the spring 21 and consequently the sliding plate brick 5 is pressed against the fixed plate brick 4.

In accordance with the slide closure of this invention, the first supporter 20 is urged by the composite dish spring 21 surrounding the former and therefore a uniform urging force is applied to the first supporter 20. The urging force of the spring 21 can be adjusted to the optimum value through calculation and measurements made by testing the spring 21 itself. The strength of the spring 21 can also be adjusted by attaching a liner piece to each of or some of the spring bearings. It will thus be seen that the slide closure of the invention is capable of easily adjusting and making uniform the contact pressure between the fixed and sliding plate bricks.

Figure 5:
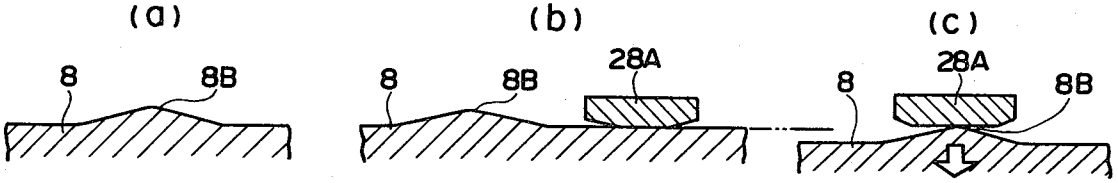
FIG. 5 shows diagrams useful for explaining the relationship between the projections on the rotor and the clamp means.

The slide closure of the invention further comprises a pair of clamp means 28 each having upper and lower claws 28A and 28B for detachably gripping the upper edge of the rotor 8 and the bottom plate 22A of the second supporter 22. As shown in FIGS. 2 and 5, a plurality of gentle projections 8B are formed on the upper edge of the rotor 8 so as to actuate the clamp means 28. A pair of the projections 8B are arranged symmetrically with the center of the rotor 8 or alternatively a plurality of the projections 8B are arranged at positions which are displaced from each other.

To actuate the clamp means 28, the upper claws 28A are put on those portion of the rotor 8 having no projections and the lower claws 28B are put on the lower side of the bottom plate 22A of the second supporter 22 and the rotor 8 and the second supporter 22 are gripped by the clamp means 28. This condition is shown in (b) of FIG. 5. Then the rotor 8 is rotated from a driving source which is not shown so that the upper claws 28A reach the position of the projections 8B and then they ride on the projections 8B as shown in (c) of FIG. 5. As a result, the rotor 8 and the second supporter 22 are gripped tightly and the spring 21 is compressed, thus separating the sliding plate brick 5 from the fixed plate brick 4.

To disassemble the slide closure, the above-mentioned operation is performed and then the driving source is disconnected. Since the horizontal pins 26 bear the weight of the slide closure, by supporting the lower side of the second supporter 22 by means of a jack or the like and removing the horizontal pins 26, it is possible to detach the sliding plate brick, the rotor and the supporting means from the vessel bottom portion. The fixed plate brick 4 can be easily removed by loosening the festening means of the fixed plate support 7 and the sliding plate brick 5 can be easily removed by lifting it from the detached slide closure. (If necessary, the pouring nozzles 6 may also be removed along with the brick 5). The slide closure can be assembled by means of the procedure reverse to the above-mentioned operations and will be apparent without any further explanation.

The clamp means according to the invention can be used for the purpose of for example inspecting and repairing the slide contacting surfaces of the fixed and sliding plate bricks in addition to the mounting and dismounting the sliding plate brick and the supporting means. More specifically, as mentioned previously, if the fixed and sliding plate bricks are separated from each other and then only two of the horizontal pins are removed, the cassette will be opened with the other horizontal pins serving as a fulcrum and in this way such operations as internal inspection and minor repairs will be easily effected. Thus, the slide closure of the invention can easily replace the fixed and sliding plate bricks with new ones and also such operations as inspection and minor repairs of the slide contacting surfaces of the fixed and sliding plate bricks can be accomplished very easily.

It will be readily apparent to those skilled in the art that the present invention can also be applied to a reciprocating type slide closure, although the sliding plate brick of the rotary type is formed substantially into a circular shape differing from the rectangular sliding plate brick of the reciprocating type and consequently the application of the invention will require some modifications in the detailed construction.

The slide closure for molten metal vessels according to the invention is constructed as described so far. Thus, the slide closure of the invention can easily adjust and make uniform the contact pressure between the fixed and sliding plate bricks, can easily effect the replacement of the fixed and sliding plate bricks, and can accomplish the replacement operation in a short period of time with the resulting increase in the work life of a molten metal vessel. Further, since the required inner inspection can be accomplished easily, the inspection and minor repairs can be effected as desired and the safety of the fixed and sliding plate bricks in use can be confirmed so as to use them up to their use life safely. As a result, the service life of the fixed and sliding plate bricks can be increased and thus the expenses can be reduced greatly.

We claim:

1. In a slide closure for a molten metal vessel having a pouring nozzle comprising:

a fixed plate brick attached to a bottom portion of said vessel and having at least one pouring opening;

a sliding plate brick having at least one opening and rotatably pressed against a lower surface of said fixed plate brick whereby rotation of said sliding plate brick brings said opening into or out of alignment with said pouring opening to open or close said pouring nozzle;

a rotor for receiving said sliding plate brick so as to be rotated therewith by a driving source; and supporting means for slidably supporting said rotor and for urging said rotor in a direction to press said sliding plate brick against said fixed plate brick with a bed plate of said vessel serving as a fulcrum;

a slide closure for a molten metal vessel having a pouring nozzle characterized in that said supporting means comprises a first supporter arranged to surround and slidably support said rotor and including an outwardly projected annular portion, and a second supporter fastened to said vessel bed plate with pins so as to urge said first supporter upwardly or in a direction to press said sliding plate brick against said fixed plate brick with dish spring means being placed between said second supporter and a lower side of the annular projection of said first supporter so as to surround said first supporter.

2. A slide closure according to claim 1, further comprising a plurality of clamp means each having an upper claw and a lower claw for detachably gripping an upper edge of said rotor and a lower edge of said second supporter, and wherein said rotor upper edge is formed with a plurality of gentle projections and said clamp means are arranged to grip portions of said rotor upper edge having no projections and the lower edge of said second supporter, whereby when said rotor is slid the upper claws of said clamp means ride on said projections to grip said rotor and said second supporter tightly.

* * * * *